United States Patent [19]

Patel

[11] Patent Number: 4,540,437

[45] Date of Patent: Sep. 10, 1985

[54] TIN ALLOY POWDER FOR SINTERING

[75] Inventor: Krishnakant B. Patel, Piscataway, N.J.

[73] Assignee: Alcan Aluminum Corporation, Cleveland, Ohio

[21] Appl. No.: 653,996

[22] Filed: Sep. 25, 1984

Related U.S. Application Data

[63] Continuation-in-part of Ser. No. 576,510, Feb. 2, 1984, abandoned.

[51] Int. Cl.[4] ..... C22C 13/00

[52] U.S. Cl. ..... 75/251; 75/252; 75/255; 420/557; 420/560; 420/472

[58] Field of Search ..... 75/251; 420/472, 557, 420/560, 252, 255; 419/11, 37

[56] References Cited

U.S. PATENT DOCUMENTS

| | | | |
|---|---|---|---|
| 118,372 | 8/1871 | Lavroff | 420/472 |
| 658,230 | 9/1900 | Berthold | 420/557 |
| 2,128,955 | 9/1938 | Montgomery | 420/472 |
| 3,156,589 | 11/1964 | Klement | 420/472 |
| 4,274,874 | 6/1981 | Obara et al. | 75/231 |

*Primary Examiner*—Wayland Stallard
*Attorney, Agent, or Firm*—Gordon P. Becker

[57] ABSTRACT

A tin alloy powder containing up to 5% P is disclosed. Reduced sensitivity to sintering conditions is achieved by use of present alloy powder in production of sintered bronze articles. Means for controlling the growth of the article during sintering are also disclosed.

20 Claims, No Drawings

TIN ALLOY POWDER FOR SINTERING

This is a continuation-in-part of application Ser. No. 06-576510 filed on Feb. 2, 1984, and now abandoned.

FIELD OF THE INVENTION

The present invention relates to powder metallurgy. In particular, the present invention relates to a novel blend of copper-based and tin-based powdered metals useful in producing sintered bronze articles and to a novel tin alloy metal powder useful in such blends.

BACKGROUND OF THE INVENTION

According to conventional practices in powder metallurgy, powdered metals can be converted into a metal article having virtually any desired shape. First, the metal powder is compressed in a die to form a "green" compact having the general shape of the die. The compact is then sintered at an elevated temperature to fuse the individual metal particles together into a sintered metal part having a useful amount of strength and yet still retaining the general shape of the die in which the compact was made. The metal powders utilized can be pure metals, alloys, or a blend of these. Generally, sintering will yield a part having between about 60% and 95% of theoretical density. If particularly high density (low porosity) is desired, a process such as hot isostatic pressing will be utilized instead of sintering. However, several applications have developed for sintered parts where porosity is desired and beneficial.

A commercially significant blend of powdered metals is a blend of about 10% tin powder and about 90% copper powder which produces a sintered "bronze alloy". According to one common practice, the sintering conditions for this bronze alloy are controlled so that a predetermined degree of porosity remains in the sintered part. Such parts can then be impregnated with oil under pressure to form a so-called permanently lubricated part. These parts have found wide application as bearings and motor components in consumer products and eliminate the need for periodic lubrication of these parts during the useful life of the product.

Solid lubricants such as graphite, lead, lead alloy, molybdenum disulfide and tungsten disulfide, as well as other additives, have been incorporated in the blends for making such sintered alloys. However, the metal powders utilized have typically been commercially pure grades of copper powder and tin powder.

It has been suggested in U.S. Pat. No. 4,274,874 that a small proportion of phosphorus (from 0.2 to 1.7%) can be incorporated in a sintered bronze alloy for the purpose of improving the lubrication properties of a bearing produced from the alloy under certain extreme service conditions. The phosphorus was incorporated in the alloy by adding a predetermined proportion of a copper-phosphorus alloy to the metal powder blend before sintering. Said patent further makes reference to a Japanese patent application No. 451/60 dated Jan. 26, 1960 which discloses the use of a sintered alloy for a sliding plate for a collector for an electric car. This sintered part consists of from 0.1 to 5 weight percent phosphorus, from 5 to 18 weight percent tin, from 2 to 10 weight percent graphite, and the balance copper. The addition of phosphorus there is solely to improve the strength and hardness of the sliding plate and the sintered alloy produced could only accept an oil content of about 1%.

These, and indeed all known commercially available sintered bronze alloys undergo a small but significant change in dimensions during sintering to make porous parts. This dimensional change is typically an increase in size and is very dependent on the sintering time and temperature. The above suggested addition of a copper-phosphorous alloy to the metal powder blend before sintering has been shown to reduce the overall growth of the part during sintering. However, blends with or without the addition of a copper-phosphorous alloy are quite sensitive to the sintering conditions. That is, a small change in sintering time and/or sintering temperature will produce a significant change in the dimensions of the sintered part. Studies of this behavior show that compacts expand during the early stages of sintering, but then begin to contract. The result, for sintering conditions commonly used for producing porous sintered bronze parts, is generally a net expansion of the part. However, because of this behavior the sensitivity of a specific blend to sintering conditions may be more significant than the net expansion of the part particularly when tolerances must be maintained in a commercial product.

Therefore, it is obviously beneficial to maintain a minimum dimensional change during sintering, but it is equally important, and in some instances more important, to have dimensional change relatively insensitive to sintering conditions.

SUMMARY OF THE INVENTION

An object of the present invention is therefore to provide a sinterable blend of copper-based and tin-based metal powders which will exhibit a minimum dimensional change during sintering.

A further object of the present invention is to provide a sinterable blend having a low sensitivity to sintering conditions.

In accordance with one or more of the objects of this invention, there is provided a sinterable blend of copper-based and tin-based metal powders having a low dimensional change during sintering and a low sintering sensitivity which blend comprises about 70 parts by weight to about 96 parts by weight of a copper-based powder, about 4 parts by weight to about 30 parts by weight of a tin-phosphorus alloy powder containing from about 0.1 weight percent to about 5.0 weight percent phosphorus, said blend further comprising up to about 20 parts by weight of additional materials such as lubricants, binders and sintering aids.

A further aspect of the present invention is a novel tin-phosphorus alloy powder utilized in said blend.

DETAILED DESCRIPTION OF THE INVENTION

Percentages expressed herein are weight percentages and temperatures are expressed in degrees Fahrenheit, unless otherwise specified.

The tin-phosphorus alloy of the present invention contains in its simplest form about 0.1% to about 5.0% phosphorus and the balance tin and incidental impurities. Advantageously the tin alloy powder contains about 0.1 to about 1.5 weight percent phosphorous and preferably from about 0.3 to about 1.0 weight percent. The incidental impurities frequently present in tin are antimony, arsenic, bismuth, cadmium, copper, iron, lead, nickel, cobalt, sulfur and zinc in levels of up to 0.1% maximum for each element. The present tin-phosphorous alloy can be prepared by alloying commercially pure tin (i.e. greater than 99% pure tin) with chemical grade phosphorus, however, it is preferable because of the extreme reactivity of pure phosphorus to produce the present alloy using a copper-phosphorus master alloy as the phosphorus source. To this end a copper-phosphorus alloy containing about 5% to about 15% phosphorus and the balance copper is a suitable phosphorus source. This, however, necessarily introduces a significant proportion of copper to the present tin-phosphorus alloy. The presence of copper in amounts up to about 5 weight percent in the present tin-phosphorus alloy have not been found detrimental and up to about 20 weight percent are believed to be tolerable and because of the ease of processing may be preferred in some instances. Other conventional alloying elements can be present in the tin alloy in amounts from about 0.1 to about 10 weight percent each up to a total (including copper) of about 30 weight percent. The present tin alloy therefore contains a minimum of about 65 weight percent tin and advantageously contains at least about 85 weight percent tin and preferably at least about 90 weight percent tin.

The present tin-phosphorus alloys can be produced by melting commercially pure tin at a temperature of about 450° F. to about 600° F. in an alloying furnace and then superheating the molten tin to a temperature of about 800° F. to 1200° F. and dissolving in the superheated tin an appropriate amount of copper-phosphorus master alloy to yield the desired level of phosphorus in the tin-phosphorus alloy. Because a significant amount of phosphorus can be lost during the alloying process, it is necessary to introduce an excess of phosphorus into the alloy. The molten tin alloy is then atomized in conventional fashion to produce tin powder having widely varying particle sizes. Said particles generally will pass thru a 20 mesh screen. Further, under typical atomization conditions, between about 70% and 95% by weight of the as atomized alloy powder will pass through a 100 mesh screen. The tin alloy powder should then be chemically analyzed to determine the actual level of phosphorus in the alloy.

All of the as-atomized tin alloy powder can be used in the blend, however to facilitate mixing and compacting, the large particles can be removed by scalping the powder on a 60 mesh screen or, advantageously, by scalping on a 100 or 150 mesh screen. Alternatively, a combination of post-atomization size reduction such as grinding, ball milling, roll milling, jet milling or the like and powder size separation techniques, such as screening or air sweeping, or the like can be utilized to obtain any desired particle size distribution in the tin-phosphorous alloy powder.

The copper-based metal powder which forms the major component of the blends of the present invention is typically a commercially pure grade of copper powder. However, a copper alloy powder containing a minor proportion of known alloying elements may be utilized in the present blends. Alloying elements such as zinc, zirconium, aluminum, silicon, lead, tin, nickel, magnesium, manganese, and chromium can be present at levels from about 0.1% to about 12.5% each with a total alloying content of up to about 20% without departing from the scope of the present invention. In addition, the copper can contain incidental impurities such as silicon, phosphorus, silver, lead, zinc, or the like in levels up to about 0.1% each.

The copper powder should have a particle size similar to that of the tin alloy powder. To this end the copper powder can be as manufactured, minus 60 mesh, or advantageously minus 100 or 150 mesh. In the preferred practice, both the tin alloy powder and the copper powder are minus 100 or minus 150 mesh.

Suitable copper powders are commercially available or may be produced according to well known processes which combine size reduction and particle size classification techniques. One such technique is wet atomization in which copper metal, for example #1 scrap copper containing 99.6% copper, is melted and water atomized. The atomized powder is then dried and reduction annealed at about 400° C. to 700° C. for a couple of hours in an endothermic atmosphere. The annealed powder is now in the form of a cake which must be pulverized and screened to yield the desired particle size product.

The copper-based metal powder and tin alloy powder are blended together by conventional means, such as by tumbling in a V-shaped blender, a double cone blender or a drum blender, to produce a blend having a nominal composition of about 90 parts copper to about 10 parts tin alloy. The blend, however, may vary depending on the properties desired in the sintered compact within the range from about 70 parts to about 96 parts by weight and preferably about 85 to 96 parts by weight copper-based metal powder to about 30 parts to about 4 parts by weight and preferably 15 to about 4 parts by weight tin alloy powder. In addition, the blend may contain graphite, lubricants, sintering aids, additives or the like in an amount up to about 20 parts by weight of the total blend consistent with conventional practices for such blends suitable for sintering. Graphite is utilized to enhance the lubricity of the finished part and may be present in amounts up to about 5% of the finished blend. Lubricants may be solid lubricants such as molybdenum disulfide or tungsten disulfide as described in U.S. Pat. No. 4,274,874, the disclosure of which is incorporated herein by reference, or blending lubricants which tend to burn off during sintering. Typical blending lubricants are lithium stearate, zinc stearate, stearic acid, wax, as well as other commercially available and proprietary formulations sold for this purpose and can be used in amounts of up to about 1% of the blend.

Further, the blend may be diluted for reasons of economy by adding to the blend iron powder as a diluent in amounts up to 80% by weight of the undiluted blend. Advantageously diluted blends contain from about 0.2 parts to about 0.8 parts by weight iron powder per 1.0 part of diluted blend and preferably, between about 0.4 parts and about 0.6 parts per 1.0 part of diluted blend. Suitable iron powder can be produced by atomization or oxide reduction and are readily available commercially. The particle size of the iron powder should be similar to though not necessarily the same as the tin alloy powder and the copper powder.

Dilution with iron is not acceptable for all applications because of asthetics, strength, tolerances or contamination considerations and is not an essential feature of the present invention.

The blends of the present invention are suitable for compacting in conventional fashion into coherent compacts which can be sintered to form porous or non-porous parts. The compact is made by evenly distributing a predetermined amount of the metal powder blend in a die of the desired shape and then pressing with a uniform pressure from about 5 tons to about 30 tons per square inch, and preferably between about 10 and 20 tons per square inch, on the blend within the die utilizing a conventional press and finally removing the compacted blend from the die. This can be done manually, semi-automatically or automatically.

The pressed compact is then sintered according to well known practice by heating in a non-oxidizing atmosphere to a temperature between about 1200° F. and 1700° F. and preferably between about 1400° F. and 1600° F. for a period of time from about 1 to about 60 minutes and preferably from about 10 to about 30 minutes. The non-oxidizing atmosphere can be dissociated ammonia, hydrogen, nitrogen, endothermic, exothermic or the like.

The density of the sintered compact is determined not only by the composition of the blend and the compacting and sintering parameters but also by the degree of porosity which is obtained in the finished material. This porosity is designed in some applications to allow the impregnation of an oil or other liquid lubricant into the sintered part for use as a "permanently" lubricated bearing or component.

Without being bound by theory, it is believed that alloying the phosphorous with tin according to the present invention creates a material which, because of its lower melting point, interacts with the other materials in the sinterable blend at an earlier point in the sintering cycle. It is theorized that this interaction may be in the form of a chemical attack by the phosphorous on the natural oxide film on the copper powder which allows for more uniform sintering reactions to take place.

The following examples show ways in which I have practiced the present invention and demonstrate the enhanced sintering stability achieved by use of the present invention.

EXAMPLE 1

A tin alloy powder was produced by air atomization in the following fashion. First, a quantity of commercially pure tin (99.8+% pure tin) was melted at a temperature of about 1000° F. to 1100° F. Then, shot of a copper-15% phosphorous alloy was dissolved therein and the resultant molten mixture was atomized with air in a conventional vertical atomization process. The tin alloy powder was collected and scalped on a 100 mesh sieve. The phosphorus content of the resultant alloy was analyzed at 0.77% by weight.

Fifty grams of the tin alloy powder was blended with 450 grams of a commercial grade of minus 150 mesh copper powder and three grams of stearic acid (lubricant) and 0.75 grams of zinc stearate (lubricant). The copper powder was produced by a water atomization process and containing a minimum of 99.6% copper, balance impurities. The blending was done by tumbling the powders in a cylindrical blender for 10 minutes.

The blend was then compacted by loading 15.92 grams of the blend into a die measuring 1.250 inches by 0.500 inches and pressing the powder into a compact having a thickness of 0.25 inches. This required about 10,000 to 15,000 pounds of pressure. The resulting compacts had a density of 6.2 grams per cubic centimeter. The green compacts were then sintered by placing them on the belt of a continuous belt furnace. The belt moved at a speed of eight inches per minute and carried the compacts through a preheat zone, sintering zone and cool down zone in succession. In the preheat zone, the compact was heated from room temperature to sintering temperature in about 8 minutes. The compact was then held at the sintering temperature for about 2.5 minutes as it passed through the sintering zone. Finally, the sintered compact was cooled to near room temperature in about 9 minutes in the cool down zone.

Three compacts were thus prepared. For one the sintering temperature was 1460° F., for the second the sintering temperature was 1500° F., and for the third the sintering temperature was 1550° F.

The length of each compact was then measured with a micrometer and dimensional change was calculated by the following formula.

$$\text{Dimension change (in/in)} = \frac{\text{(Length if sintered compact)} - \text{(length of die)}}{1.250}$$

Data for these sintered compacts are shown in Table I.

EXAMPLE 2

The process of example 1 was followed except that commercially pure tin was heated to about 450° F. to 600° F. and atomized in air without making any alloying additions.

The sintered compacts produced thus represent sintered bronze parts produced without use of the present invention. Dimensional change data are shown in Table I.

TABLE I

DIMENSIONAL CHANGE OF COMPACTS DURING SINTERING IN INCHES/INCH

| Sintering Temp. | Compacts of Example 1 Sn—P alloy | Compacts of Example 2 Pure Sn powder |
|---|---|---|
| 1460° F. | +0.006 | +0.014 |
| 1500° F. | +0.009 | +0.024 |
| 1550° F. | +0.009 | +0.018 |

It can thus be clearly seen that the dimensions of the blends produced according to the present invention are not affected by changes in sintering conditions nearly to the extent that conventional blends are affected.

EXAMPLE 3

The process of example 1 was followed, except that two tin alloy powders were produced. The first was produced by alloying with shot of a copper -15% phosphorous alloy, and when analyzed had 0.51% by weight phosphorous and 4.94% copper. The second tin alloy powder was produced in a similar manner, except that it was alloyed with the copper-15% phosphorous alloy and a further addition of commercially pure copper. The second tin alloy powder was analyzed and contained 0.46% phosphorous and 19.22% copper.

Three blends were then produced using the process described in Example 1 except that two different tin alloy powders were utilized instead of only one tin alloy powder. The compositions of the blends produced are shown in Tables II and III.

TABLE II

| | WEIGHT (IN LBS.) OF POWDERS IN BLEND | | |
|---|---|---|---|
| Blend # | copper | 1st tin alloy | 2nd tin alloy |
| 1 | 22.28 | 2.25 | 0.467 |
| 2 | 22.17 | 1.59 | 1.255 |
| 3 | 22.00 | 0.804 | 2.19 |

TABLE III

| COMPOSITION OF BLEND | | | | |
|---|---|---|---|---|
| Blend # | Copper (from copper powder) | Phosphorous | Copper (from tin alloy powder) | Tin |
| 1 | 89.12 | 0.055 | 0.80 | 10.01 |
| 2 | 88.68 | 0.052 | 1.27 | 10.04 |
| 3 | 88.00 | 0.056 | 1.84 | 10.05 |

These blends were then compacted as described in Example 1. The compacts were then sintered in the continuous belt furnace described in Example 1 except that the belt speed was set at four inches per minute. Compacts were sintered at three different temperatures and dimensional change measured. Data are shown in Table IV.

TABLE IV

| DIMENSIONAL CHANGE OF COMPACTS SINTERED AT VARIOUS TEMPERATURES | | | |
|---|---|---|---|
| Compacts from | Sintering Temperature | | |
| Blend # | 1500° F. | 1530° F. | 1560° F. |
| 1 | +0.010 | +0.0118 | +0.002 |
| 2 | +0.014 | +0.016 | +0.0072 |
| 3 | +0.0196 | +0.019 | +0.0100 |

From this data it is clearly seen that the variation in DC values with temperature for a given blend remains at a desirably low level, however the absolute values of the DC numbers increases from blend 1 to blend 3 as the copper content of the tin alloy powders increases.

EXAMPLE 4

Blends 1, 2 and 3 from Example 3 together with a commercially available 90% copper, 10% bronze alloy powder which contained no phosphorous addition were used in this example.

These four powder blends were then compacted into collar bearings having a wall thickness of about 1/16 inch and were sintered in a continuous belt furnace having the same series of zones as the furnace used in Example 1. However, a belt speed of 10.5 inches per minute provided a sintering time of about 2 minutes in the present furnace.

Collar bearings of all four powders were sintered at each of four different temperatures using a belt speed of 10.5 inches per minute. Data are shown in Table V.

TABLE V

| DIMENSIONAL CHANGE OF COLLAR BEARING COMPACTS SINTERED AT VARIOUS TEMPERATURES | | | | |
|---|---|---|---|---|
| Collar Bearings | SINTERING TEMPERATURE | | | |
| from | 1525° | 1545° | 1565° | 1585° |
| Blend #1 | +0.010 | 0.011 | 0.008 | 0.006 |
| Blend #2 | +0.016 | 0.017 | 0.017 | 0.013 |
| Blend #3 | +0.020 | 0.022 | 0.021 | 0.017 |
| Commercial Blend | 0.016 | 0.018 | 0.012 | 0.0 |

From this data it can be seen that the data shown in Example 3 is largely confirmed even if the shape of the compact and sintering furnace are changed. It should be noted, however, that under some sintering conditions, the commercial powder used in Example 4 can show a lower change in DC values than any of Blends 1, 2, or 3. Such conditions, however, are generally regarded as unacceptable because the sintered parts produced are unacceptable from a commercial, performance or metallurgical standpoint.

As seen in the above examples, the tin alloy powder of the present invention may be a blend of tin powders, said blend having a net composition within the ranges previously stated. However, individual tin powders within the blend may contain alloying elements at levels outside said ranges. For example, unalloyed tin powder, tin-copper alloy powders and tin-copper-phosphorous alloy powders may be used in such blends in any combination or with other tin-based powders to achieve the desired net composition. Further, the copper component of the tin alloy powder of the present invention, in addition to being a necessary impurity when utilizing a copper-phosphorous master alloy as the phosphorous source for the tin alloy powder, has been found to have a measurable and sometimes desirable effect on the shrinkage or growth characteristics of the resultant sintered bronze parts. In some applications, it may be desirable to independently control the copper content of tin alloy powder, or blend thereof, to control the growth of the resultant sintered bronze parts.

Similarly, it is also possible to utilize a blend of copper-based metal powders instead of a single copper-based metal powder when producing the blends of the present invention.

I claim:

1. A tin alloy powder comprising a major proportion of tin, about 0.1 to 5.0 weight percent phosphorus and incidental impurities.

2. The tin alloy powder of claim 1 further comprising up to about 20 weight percent copper.

3. The tin alloy powder of claim 1 comprising about 0.1 to 1.5 weight percent phosphorus.

4. The tin alloy powder of claim 1 comprising about 0.3 to 1.0 weight percent phosphorus.

5. The tin alloy powder of claim 3 further comprising up to about 20 weight percent copper.

6. The tin alloy powder of claim 4 further comprising up to about 20 weight percent copper.

7. The tin alloy powder of claim 1 blended with a copper-based metal powder, comprising at least about 80 weight percent copper, said blend comprising about 4 to 30 parts by weight of said tin alloy powder, about 70 to 96 parts by weight of said copper-based metal powder and up to 20 parts by weight of a material selected from lubricant, graphite, binders and mixtures thereof.

8. The blend of claim 7 comprising about 4 to 15 parts by weight of said tin alloy and about 85 to 96 parts by weight of said copper-based metal powder.

9. The tin alloy powder of claim 4 blended with a copper-based metal powder comprising at least about 80 weight percent copper, said blend comprising about 4 to 15 parts by weight of said tin alloy powder, about 85 to about 96 parts by weight of said copper-based metal powder and up to 20 parts by weight of a material selected from lubricant, graphite, binders and mixtures thereof.

10. The blend of claim 7 diluted by further blending with iron powder to produce a diluted blend comprising 20 to 80 parts of the blend of claim 7 and 20 to 80 parts of iron powder, all powders in said diluted blend having a particle size disposed to pass through a 60 mesh screen.

11. A method for producing a sinterable blend having a reduced sintering sensitivity comprising alloying tin with about 0.1 to about 5.0 weight percent phosphorous, atomizing said tin alloy to make a tin powder, and blending about 4 parts to about 30 parts by weight of said tin powder, about 70 parts to about 96 parts by weight of a copper powder and up to 20 parts by weight of a material selected from lubricant, graphite, binder and mixtures thereof to produce said sinterable blend.

12. The method of claim 11 wherein said sinterable blend comprises about 85 to about 96 parts by weight copper powder and about 4 to about 15 parts by weight tin powder and up to 20 parts by weight of a material selected from lubricant, graphite, binders, and mixtures thereof.

13. The method of claim 11 wherein said tin is alloyed with about 0.1 to about 1.5 weight percent phosphorous.

14. The method of claim 11 wherein said tin is alloyed with about 0.3 to about 1.0 weight percent phosphorous.

15. A method of sintering comprising; preparing a blend comprising about 70 parts to about 96 parts by weight copper powder and about 4 parts to about 30 parts by weight tin powder and up to about 20 parts by weight of a material selected from lubricant, graphite, binders and mixtures thereof, compressing said blend to form a coherent compact, and sintering said compact in a non-oxidizing atmosphere at a temperature between about 1200° F. and 1700° F. wherein the improvement comprises preparing said blend with a tin powder comprising a major proportion of tin, about 0.1 to 5.0 weight percent phosphorous and incidental impurities.

16. The method of claim 15 wherein said tin powder is prepared by melting tin to form a molten pool thereof, adding to said pool a predetermined proportion of phosphorous and atomizing said pool.

17. The method of claim 16 wherein said phosphorous is added to said pool in the form of a copper-phosphorous alloy containing up to about 15 percent by weight phosphorous.

18. The product produced by the method of claim 15.

19. The product produced by the method of claim 17.

20. The blend produced by the method of claim 11.

* * * * *